US005090873A

United States Patent [19]

Fain

[11] Patent Number: 5,090,873

[45] Date of Patent: Feb. 25, 1992

[54] CRANKCASE OIL SEPARATOR

[75] Inventor: Gary K. Fain, Sidney, Ohio

[73] Assignee: Copeland Corporation, Sidney, Ohio

[21] Appl. No.: 452,006

[22] Filed: Dec. 18, 1989

[51] Int. Cl.[5] ..... F04B 39/04

[52] U.S. Cl. ..... 417/228; 184/6.5; 184/6.23; 55/204

[58] Field of Search ..... 417/228; 123/196 S, 123/196 R, 41.86; 55/52, 199, 204; 137/197; 184/6.5, 6.23; 62/470

[56] References Cited

U.S. PATENT DOCUMENTS 4,404,936 9/1983 Tatebe et al. ..... 123/196 R 4,886,019 12/1989 Davis et al. ..... 123/41.86

*Primary Examiner*—Richard A. Bertsch

*Assistant Examiner*—Charles Freay

*Attorney, Agent, or Firm*—Harness, Dickey & Pierce

[57] ABSTRACT

In a refrigeration motor compressor of the hermetic type containing an electric motor compartment, and a crankcase compartment, an oil separator installed in the crankcase arranged to prevent oil splash from entering the system. The oil separator includes a generally nautilus shell-shaped structure, an elongated tubular structure, and a check valve assembly for controlling flow. The shell-shaped structure has cross baffles for controlling flow characteristics and a pin for centering the check valve assembly. The check valve assembly includes a helical spring with one end positioned in a retainer in the tubular structure. The other end of the spring fits around the pin and abuts an orifice disk in the shell-shaped structure.

21 Claims, 2 Drawing Sheets

CRANKCASE OIL SEPARATOR

BACKGROUND AND SUMMARY OF THE INVENTION

This invention relates to compressor systems, and more particularly to an oil separator for use in the crankcase of an accessible hermetic refrigerant compressor.

In refrigerating systems using self-contained motor compressor units in which the returning refrigerant is used to cool the motor it is important that the crankcase pressure be maintained at a sufficiently low level relative to the rest of the system to permit return of lubricant collected in the motor compartment to the crankcase. During the starting period of the compressor, refrigerant mixed with the lubricant in the crankcase will foam and the foamed oil will tend to be drawn from the crankcase. Typically check valve passages have been provided for permitting pressure relief from the crankcase while preventing loss of lubricant. However, additional problems have occurred in that the refrigerant being supplied to the intake manifold may back up through such passages to maintain or even increase the crankcase pressure. Piston blow-by gas is another factor making it difficult to maintain crankcase pressure at a sufficiently low level.

It is an object of the present invention to overcome the disadvantages of previously known means for obtaining crankcase pressure reduction in refrigerating units of this type and to provide a novel and improved construction for venting the crankcase and maintaining lubricant supply in an efficient and reliable manner.

It is a further object of this invention to allow for the venting of piston blow-by gas while preventing the loss of entrained oil.

During a flooded start transient the crankcase is filled with liquid refrigerant. The rotating crank generates a great deal of heat from drag loss and causes the liquid to flash. It is another object of the present invention to allow this gas to vent off at a metered rate while centrifugally separating the oil.

During normal operation, the crankcase oil separator inlet of the present invention is oriented relative to the crank throw to prevent piston blow-by gas from carrying away entrained oil. This results in a lower system oil circulation rate and reduced compressor oil pump-out rate. During a flooded start or defrost condition, the crankcase oil separator provides a centrifugal oil separating capability to keep oil from being washed out when liquid refrigerant flashes. When a flooded start occurs an orifice disk closes and meters flow at a rate that can be handled by the crankcase oil separator. The larger entrained oil droplets are removed from the flow and gravity drained back out the lower part of the inlet into the oil sump.

There are several advantages to the present invention. First, the reliability of the compressor is improved by reducing the chance of a lubrication related failure due to oil loss. Second, the possibility of slugging during a flooded start is greatly reduced by oil retention. Third, the amount of running time spent at low oil pressure due to refrigerant in the lube system during flooded start is reduced. Fourth, the crankcase oil separator allows crankcase pressure to be vented off relatively quickly without major oil loss. The reduced oil pump-out rate is particularly important on systems with long piping lines where oil is slow to return.

The foregoing and other objects and advantages will become more apparent when viewed in light of the accompanying drawings and the following description wherein.

DETAILED DESCRIPTION OF A PREFERRED EMBODIMENT

Figure 1:
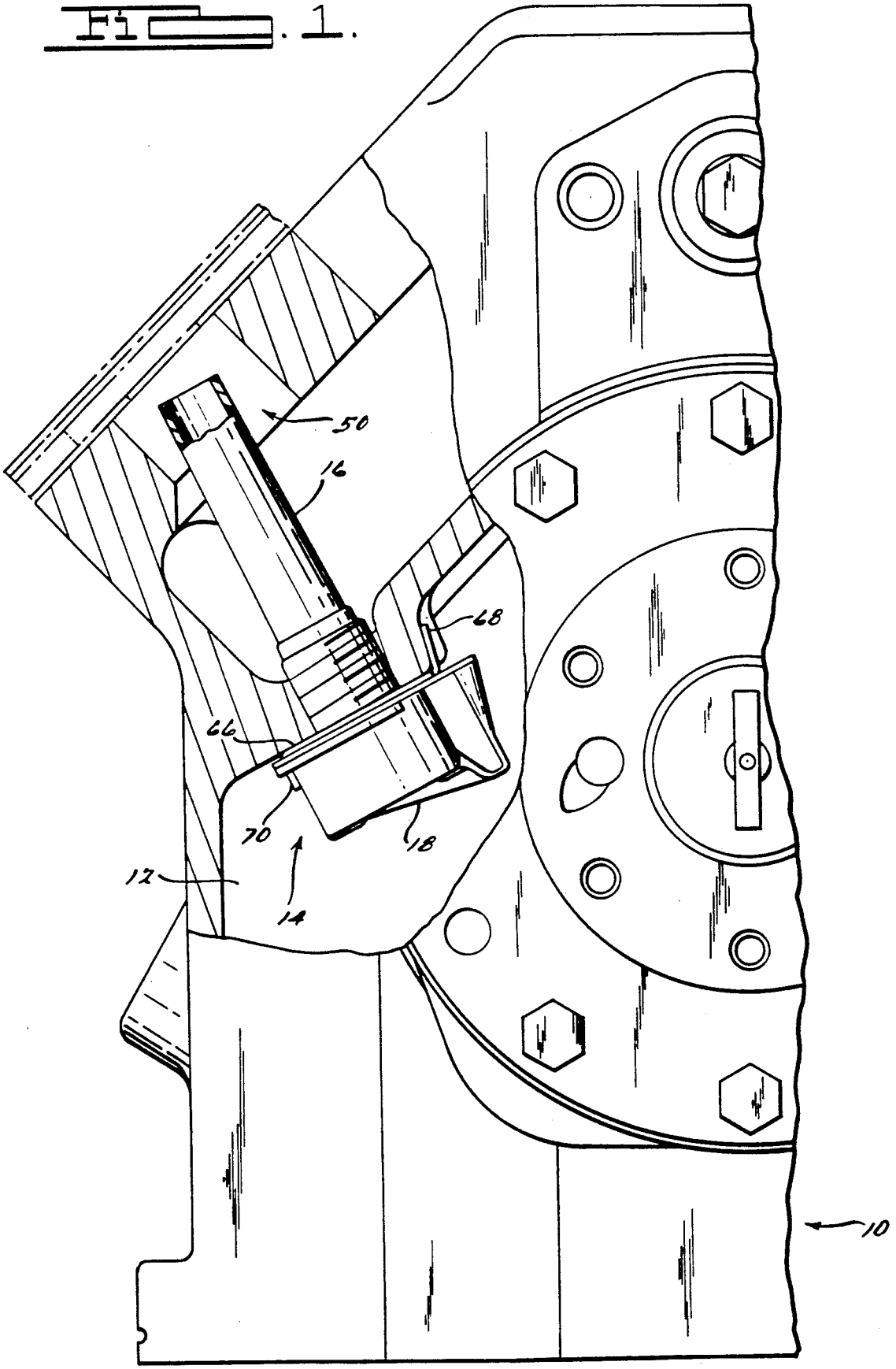
FIG. 1 is a partial, front view of a conventional refrigerant compressor with a cutaway view showing the novel crankcase oil separator of the present invention installed in the crankcase.

Referring now to the drawings, there is illustrated a hermetic motor compressor generally indicated at 10 and of a type widely known in the refrigeration trade. Threadably engaged into the upper side wall of crankcase 12 of the compressor 10 is the crankcase oil separator 14 of the present invention.

In the preferred embodiment of the invention, an elongated first body portion 16 is secured to a second body portion 18. Following the preferred procedure, the first body portion 16 and second body portion 18 are plastic injection molded and ultrasonically welded together. Of course, other materials and methods of joining may work as well. The first and second body portions 16, 18 may even be formed from the same piece, eliminating the need for later joining both portions 16, 18. The two body portions 16, 18 are welded together at a bottom face 20 of the first body portion 16 and an upper lip 22 of the second body portion 18. The bottom face 20 and upper lip 22 have matching shapes in the preferred embodiment.

The first body portion 16 is substantially tubular in shape but has a stepped down region 24 formed approximately one-third of the way up the tube from the bottom face 20. This results in the first body portion 16 having two concentric tubular portions 26 and 28 formed from one piece. A purpose of the stepped down region 24 is to provide a shoulder 30 for one end 40 of a check valve spring 32. The tube of the first body portion 16 extends into a high velocity passage 50 through which suction gas movably flows from the crankcase to the suction gas manifold and valve plate (not shown). This produces a relatively lower pressure in the crankcase 12 for oil transfer/return.

The check valve spring 32 is part of a check valve assembly 34 which includes the helical spring 32 and an annular orifice disk 36. One end 40 of the spring 32 resides in a retainer 38. The retainer 38 is sized to fit onto the shoulder 30. The other end 42 of the spring 32 may be wound to a small inside radius so that it fits around a metal pin 44. The pin 44 has one end 46 molded into the second body portion 18 and the other end 48 is positioned axially inside the first body portion 16. End 42 of the spring 32 abuts an orifice disk 36 which is annularly positioned around the pin 44. As the pressure inside the second body portion 18 increases the orifice disk 36 will rise up the pin 44 and at the same time will be resisted by the spring 32. The greater the pressure inside the second body portion 18 the more the disk 36 will compress the spring 42 and the farther it will rise up the pin 44. The disk 36 can rise until it contacts the bottom face 20 of the first body portion 16. This bottom face 20 may have a rounded seat 52 to prevent the disk 36 from sticking to the bottom face 20 due to trapped oil between the surface of the disk 36 and the bottom face 20.

Figure 2:
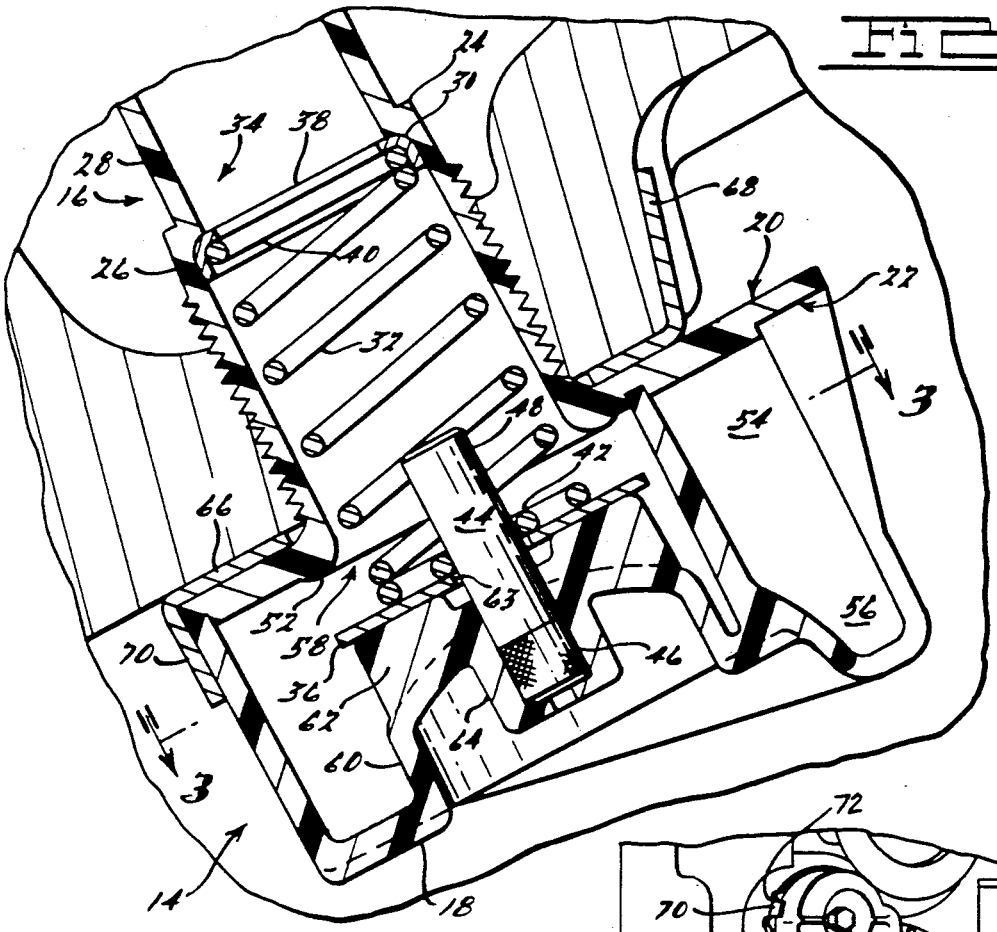
FIG. 2 is an enlarged cross-sectional view of a portion of the crankcase oil separator of FIG. 1.
Figure 4:
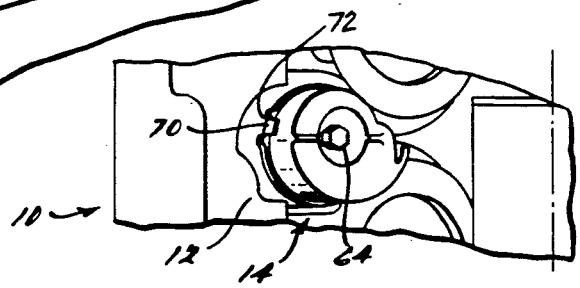
FIG. 4 is a partial perspective view of the oil separator orientation with respect to the center line of the crankshaft.
Figure 3:
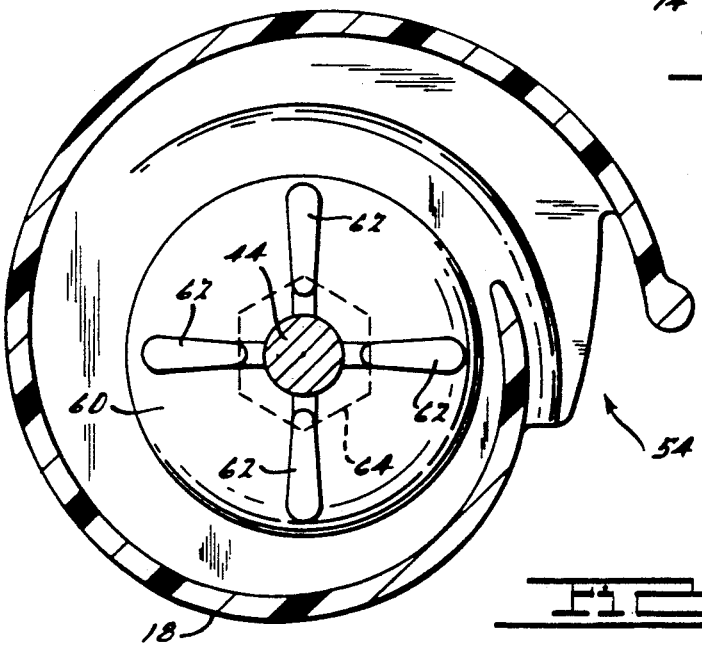
FIG. 3 is a sectional view taken generally along line 3—3 in FIG. 2.

The second body portion 18 is shaped much like the spiral section of a nautilus shell. The second body portion 18 has an inlet passage 54 which at its lower end is also an exit passage 56. The second body portion 18 also has an opening 58 which matches the hole in the bottom face 20 of the first body portion 16 when both body portions 16 and 18 are assembled together. In addition the second body portion 18 has a raised island portion 60 which holds one end 46 of the pin 44. In the preferred embodiment, the raised island portion 60 is circular in shape and has cross baffles 62 molded on the top surface thereof. The cross baffles 62 serve as a bottom seat for the disk 36 when it is in the lowermost position, as shown in FIG. 2. While the disk 36 is in its uppermost position seated against the bottom face 20 of the first body portion 16, the baffles 62 prevent the flow next to the raised island portion 60 from swirling and the only gas flow through the separator is through the clearance space 63 between pin 44 and the center opening in disk 36. This prevents the creation of low pressure in the center which could suck oil up into the gas flow. A hex nut 64 may also be cast into the bottom of the second body portion 18 to assist in installation of the crankcase oil separator 14. The first body portion 16 may be threaded for installation into a hole in the wall of the crankcase 12.

Oil separation is accomplished in two principal ways. First, the oil separator inlet 54 orientation to the crank throw is positioned close to the rotating crank throw and located so that oil splash cannot enter directly. Additionally, the swirling draft induced by the rotating throw is at right angles to the oil separator inlet 54 so that the momentum of larger oil droplets resists the entry turn. The oil separator 14 may be oriented by means of a washer 66 with two tabs. One tab 68 may be bent upward into a suitable recess in the wall of the crankcase 12 and the other tab 70 may be bent down into a slot 72 formed in the bottom face 20 of the first body portion 16 and the upper lip 22 of the second body portion 18.

Secondly, during a flooded start, or whenever the pressure drop across the oil separator 14 exceeds a predetermined pressure, the orifice disk 36 closes. The pressure continues to increase and the gas velocity through clearance opening 63, becomes high enough for centrifugal separation to occur. The opening 63 is sized to meter the flow at a rate which the oil separator 14 can handle without being plugged with liquid. When the entrained oil is removed from the gas and settles out it flows by gravity back to the exit 56. However, for the oil to leave the oil separator through the exit 56 the pressure differential of the entire separator must be less than the head of oil necessary to drain. The opening 63 is sized for high pressure differential and the exit 56 area is large and radiused for low pressure differential in the preferred embodiment.

While it will be apparent that the preferred embodiment of the invention disclosed is well calculated to provide the advantages and features above stated, it will be appreciated that the invention is susceptible to modification, variation and change without departing from the proper scope or fair meaning of the subjoined claims.

What is claimed is:

1. A venting apparatus for installation in a refrigerant motor compressor crankcase unit to prevent major crankcase oil loss to the system, said apparatus comprising: a first body portion; a second body portion depending from one end of said first body portion, said second body portion having an opening in relationship with an opening in said first body portion; and means for controlling flow through said openings positioned within said first and said second body portions, said means for controlling flow through said openings positioned between said openings.

2. The apparatus of claim 1, wherein said means for controlling flow is a check valve assembly.

3. The apparatus of claim 1, wherein said first body portion is at least partially threaded to be engaged within a hole in said crankcase.

4. The apparatus of claim 1, further comprising: a hex nut formed in said second body portion to facilitate installation.

5. The apparatus of claim 1, wherein said first and said second body portions are made from a polymeric material.

6. A venting apparatus for installation in a refrigerant motor compressor crankcase unit, comprising: means for producing a lower pressure in said crankcase compared to suction pressure in the motor compartment; means for orienting said apparatus in said crankcase so that oil splash cannot directly enter an inlet of said apparatus; and means for separating oil from gas.

7. The apparatus of claim 6, wherein said means for producing a lower pressure includes an elongated first body portion extending from a top surface of said crankcase into a high velocity passage through which suction gas normally flows.

8. The apparatus of claim 6, wherein said means for orienting includes a washer with tabs, said tabs to engage said crankcase and said apparatus thereby positioning said apparatus with respect to said crankcase in a predetermined orientation such that said inlet of said apparatus is close to a rotating crank throw and at right angles to a swirling draft induced by said crank throw.

9. The apparatus of claim 6, wherein said means for separating includes a check valve assembly, said check valve assembly comprising a spring and disk, said spring extending from within a first body portion of said apparatus, through an opening in said first body portion, into a second body portion of said apparatus where said spring abuts said disk, as pressure increases in said crankcase, gas and oil enter said second body portion causing said disk to exert a force against said spring, thereby compressing said spring until said disk makes contact with said opening of said first body portion.

10. The apparatus of claim 9, wherein said second body portion is shaped in the form of a nautilus shell section having a raised island portion in the center thereof, said raised island portion having cross baffles on a top surface thereof.

11. A method for installing an oil separator in the crankcase of a refrigerant motor compressor, said method comprising: placing an inlet of said oil separator close to a rotating crank throw of said crankcase; and orientating said inlet at right angles to a swirling draft induced by said rotating crank throw so that oil splash cannot directly enter said inlet.

12. The method of claim 11, further comprising: positioning an elongated portion of said oil separator from the top of said crankcase, at a predetermined angle off of vertical, into a high velocity passage through which suction gas normally flows.

13. An oil separator installed in a crankcase of a refrigerant motor compressor to prevent major crankcase oil loss to the system, said oil separator comprising: an elongated first body portion having a bottom face with an opening therein and another opening at an opposite end of said first body portion; a second body portion secured to said bottom face of said first body portion, said second body portion having a passage which acts as both an inlet and exit, said second body portion also having an opening aligned with said opening in said bottom face for fluid communication with said first body portion; a check valve assembly positioned within said first and said second body portions for controlling fluid communication through said opening in said second body portion and said bottom face; said second body portion having a generally nautilus shell section shape with a raised island portion in the center thereof; said raised island portion having cross baffles on a top surface thereof; said check valve assembly comprising a helical compression spring and an annular disk, said spring contained at one end thereof by a retainer in said first body portion and said spring abutting said disk at another end thereof within said second body portion; said bottom face of said first body portion having a rounded seat thereon to prevent said disk from sticking to said bottom face as pressure increases in said second body portion to move said disk upward against said bottom face; said first body portion being at least partially threaded for engagement within a hole in said crankcase; said second body portion having a hex nut formed therein to facilitate installation of said oil separator; and a washer having tabs formed thereon, said tabs to engage said crankcase and said oil separator to assist in establishing a predetermined orientation for said oil separator inlet.

14. A venting apparatus for installation in a refrigerant motor compressor crankcase unit to prevent major crankcase oil loss to the system, said apparatus comprising: a first body portion; a second body portion depending from one end of said first body portion, said second body portion having an opening in relationship with an opening in said first body portion; and a check valve assembly positioned within said first and said second body portions, positioned between said openings, for controlling flow through said openings, said check valve assembly including a helical compression spring, said spring having a first end which abuts a retainer within said first body portion and a second end which abuts an annular disk, said disk and said second end of said spring being axially movable along a pin in said second body portion.

15. A venting apparatus for installation in a refrigerant motor compressor crankcase unit to prevent major crankcase oil loss to the system, said apparatus comprising: a first body portion; a second body portion depending from one end of said first body portion, said second body portion having an opening in relationship with an opening in said first body portion; a check valve assembly positioned within said first and said second body portions, positioned between said openings, for controlling flow through said openings, said check valve assembly including a helical compression spring, said spring having a first end which abuts a retainer within said first body portion and a second end which abuts an annular disk, said disk and said second end of said spring being axially movable along a pin in said second body portion; and a rounded seat formed on a bottom face of said first body portion for preventing said disk from sticking to said bottom face when said disk rises as the pressure in said second body portion increases.

16. A venting apparatus for installation in a refrigerant motor compressor crankcase unit to prevent major crankcase oil loss to the system, said apparatus comprising: a first body portion; a second body portion depending from one end of said first body portion, said second body portion having an opening in relationship with an opening in said first body portion; and a check valve assembly positioned within said first and said second body portions, position between said openings, for controlling flow through said openings, said check valve assembly including a helical compression spring, said spring having a first end which abuts a retainer within said first body portion and a second end which abuts an annular disk, said disk and said second end of said spring being axially movable along a pin in said second body portion, said disk being designed to close against said first body portion opening when the pressure drop across said apparatus exceeds 10 psi.

17. A venting apparatus for installation in a refrigerant motor compressor crankcase unit to prevent major crankcase oil loss to the system, said apparatus comprising: a first body portion; a second body portion depending from one end of said first body portion, said second body portion having an opening in relationship with an opening in said first body portion; means positioned within said first and said second body portions, said means positioned between said openings, for controlling flow through said openings; and means for centrifugally separating oil while venting gas from said crankcase.

18. A venting apparatus for installation in a refrigerant motor compressor crankcase unit to prevent major crankcase oil loss to the system, said apparatus comprising: a first body portion; a second body portion depending from one end of said first body portion, said second body portion having an opening in relationship with an opening in said first body portion, said second body portion being formed in a shape similar to a nautilus shell section and having a raised island portion interiorly of said second body portion to centrifugally separate oil while venting gas from said crankcase; and means positioned within said first and said second body portions, said means passing through said openings, for controlling flow through said openings.

19. A venting apparatus for installation in a refrigerant motor compressor crankcase unit to prevent major crankcase oil loss to the system, said apparatus comprising: a first body portion; a second body portion depending from one end of said first body portion, said second body portion having an opening in relationship with an opening in said first body portion; said second body portion being formed in a shape similar to a nautilus shell section and having a raised island portion interiorly of said second body portion to centrifugally separate oil while venting gas from said crankcase; cross baffles formed on a top surface of said raised island portion for preventing flow next to the raised island portion from swirling; and means positioned within said first and said second body portions, said means passing through said openings, for controlling flow through said openings.

20. A venting apparatus for installation in a refrigerant motor compressor crankcase unit to prevent major crankcase oil loss to the system, said apparatus comprising: a first body portion; a second body portion depending from one end of said first body portion, said second body portion having an opening in relationship with an opening in said first body portion; means positioned within said first and said second body portions, said means passing through said openings, for controlling flow through said openings; and means for orienting said apparatus in said crankcase to prevent oil splash from directly entering said apparatus.

21. A venting apparatus for installation in a refrigerant motor compressor crankcase unit to prevent major crankcase oil loss to the system, said apparatus comprising: a first body portion; a second body portion depending from one end of said first body portion, said second body portion having an opening in relationship with an opening in said first body portion; means positioned within said first and said second body portions, said means positioned between said openings, for controlling flow through said openings; and means for orientating said apparatus in said crankcase to prevent oil splash from directly entering said apparatus, said means for orienting including a washer with tabs, at least one tab to engage said apparatus thereby locating a predetermined orientation for said apparatus.

* * * * *

UNITED STATES PATENT AND TRADEMARK OFFICE

CERTIFICATE OF CORRECTION

PATENT NO. : 5,090,873

DATED : February 25, 1992

INVENTOR(S) : Gary K. Fain

It is certified that error appears in the above-identified patent and that said Letters Patent is hereby corrected as shown below:

Column 6, line 16, "position" should be -- positioned --.

Signed and Sealed this

Twenty-ninth Day of June, 1993

*Attest:*

*Attesting Officer*

Michael K. Kirk

MICHAEL K. KIRK

*Acting Commissioner of Patents and Trademarks*